United States Patent [19]

Bach

[11] Patent Number: 4,743,202

[45] Date of Patent: May 10, 1988

[54] CURRENT-CARRYING BUILDING ELEMENT

[75] Inventor: Erik Bach, Billund, Denmark

[73] Assignee: Interlego A.G., Baar, Switzerland

[21] Appl. No.: 852,669

[22] PCT Filed: Aug. 2, 1985

[86] PCT No.: PCT/DK85/00073

§ 371 Date: May 1, 1986

§ 102(e) Date: May 1, 1986

[87] PCT Pub. No.: WO86/01342

PCT Pub. Date: Feb. 27, 1986

[30] Foreign Application Priority Data

Aug. 3, 1984 [DK] Denmark ..... 3767/84

[51] Int. Cl.[4] ..... A63H 33/04

[52] U.S. Cl. ..... 439/53; 446/91

[58] Field of Search ..... 339/18 R, 18 B, 184 R, 339/185; 446/91; 200/307; 439/43, 53

[56] References Cited

U.S. PATENT DOCUMENTS

| | | | |
|---|---|---|---|
| 3,237,341 | 3/1966 | Janning | 446/91 |
| 3,484,984 | 12/1969 | Fischer | 446/91 |
| 3,652,976 | 3/1972 | Tymkewicz | 339/184 R |
| 4,340,268 | 7/1982 | Scalera | 339/18 R |
| 4,423,465 | 12/1983 | Teng-ching et al. | 200/307 X |
| 4,552,541 | 11/1985 | Bolli | 446/91 |
| 4,556,393 | 12/1985 | Bolli | 446/91 |
| 4,589,715 | 5/1986 | Weisenburger | 339/18 R X |

*Primary Examiner*—John McQuade

*Attorney, Agent, or Firm*—Kane, Dalsimer, Sullivan, Kurucz, Levy, Eisele, and Richard

[57] ABSTRACT

A toy building block having on one face thereof at least one row of mechanical coupling pins and opposite thereto mechanical counter-coupling tubes for coupling said toy building block to a similar toy building block either with the row of said coupling pins parallel to a corresponding row of coupling pins of said similar block or perpendicular to said corresponding row. The toy building block includes first and second current paths connected to first and second contact areas respectively designed to establish electrical connection with first and second contact areas in a similar block. The first and second contact areas are disposed in first and second angular sectors about adjacent coupling pins. The angular sectors are offset from each other and do not overlap regardless of whether the building block row of coupling pins is parallel or perpendicular to the row of coupling pins of the similar block.

7 Claims, 3 Drawing Sheets

CURRENT-CARRYING BUILDING ELEMENT

BACKGROUND OF THE INVENTION

The invention concerns a building element for a building set, said element comprising a plurality of contiguous module units, at least some of which have a coupling stud protruding co-axially with a central axis of the module unit so that the mutual centre-to-centre distance of the coupling studs is equal to a multiple of the module measure, said element further comprising complementary coupling means for cooperation with coupling studs on an adjacent element for coupling the elements together mechanically in a plurality of possible mutual angular positions, said element having a first current path connected to first contact areas designed to establish electrical connection with first contact areas in an adjacent element, said element also having a second current path electrically insulated from the first current path and connected to second contact areas designed to establish electrical connection with second contact areas in an adjacent element.

For example the Swiss Patent Specification No. 455 606 discloses a toy building set, whose building blocks are provided with conductive areas for conduction of electric current when the building elements are coupled together. This conduction, however, just concerns unipolar current, but it is known in principle from the German Offenlegungsschrift No. 25 52 587 that a building block may contain several current paths, where, of course, short circuiting between these current paths is to be avoided. How the short circuiting is to be avoided in practice, however, is not known.

The object of the invention is to provide a building element of the present type where the contact areas for the current paths are so positioned as to provide, on one hand, security against short circuiting and, on the other, such location of the contact areas as allows the element to be manufactured fully automatically in a very rapid and inexpensive manner.

SUMMARY OF THE INVENTION

This object is achieved in that the first and the second contact areas are disposed in respective first and second angle sectors which do not overlap each other irrespective of mutual angular rotations corresponding to the said possible angular positions, and that contact areas are provided which are disposed around adjacent central axes in mutually different angle sectors. It will readily be appreciated that each of the building elements might be provided with a plurality of multi-plug means, each of which comprises e.g. eight contact points evenly spaced along a circle, where every other contact point is associated with its respective one of two electric current paths. If the elements can be coupled together in only four mutually perpendicular positions, it will be appreciated that short circuiting can never take place in the mentioned structure. However, the mentioned structure is inapplicable in practice because of the many contact points, and the invention is based on the finding that the contact points belonging to the mentioned multi-plug means can be distributed over a greater area of the building element, said area being normally covered when two building elements are coupled together so that, for one thing, contact is obtained between the respective current paths—without any risk of short circuiting—and, for another, the density of contact points is reduced significantly so that the structure of the building element is simplified considerably.

BRIEF DESCRIPTION OF THE DRAWINGS

The invention will be explained more fully by the following description of some embodiments with reference to the drawing, in which.

DETAILED DESCRIPTION OF THE PREFERRED EMBODIMENTS

Figure 1:
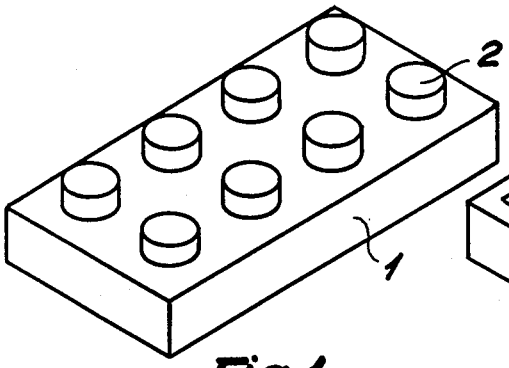
FIGS. 1 and 2 are top and bottom views, respectively, of a portion of a known building element.
Figure 2:
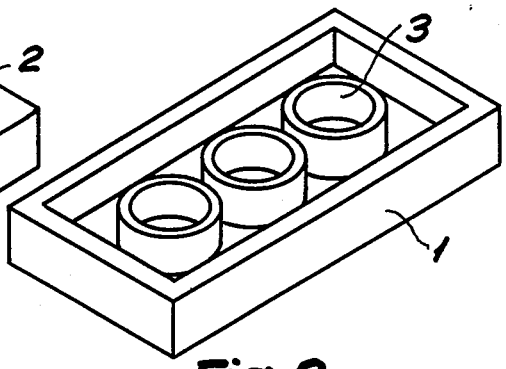

FIGS. 1 and 2 show a known form of a building element for mechanical coupling with corresponding building elements from a building set. Thus, the building element can typically consist of a hollow box 1 whose top side is provided with coupling studs 2 and whose underside is open, as appears from FIG. 2. Coupling tubes 3 are provided on the underside and in the cavity of the element, and the elements can be coupled together mechanically in a known manner by clamping the coupling studs either between two coupling tubes and one of the side walls of the element or between a coupling stud and two of the side walls of the element. It is observed that the invention is not restricted to use in connection with the embodiment shown in FIGS. 1 and 2 of a building element, but is also useful in connection with any other types of building elements with mechanical coupling means placed on the element with a certain mutual module distance, so that a large number of mutually displaced and mutually angularly rotated positions are possible. It will moreover be appreciated that the coupling studs are not necessarily disposed on the same side of the element. The decisive condition is just that the element is composed of a plurality of module units, which are shown in broken lines in FIG. 3, and which can be provided with a coupling stud.

Figure 3:
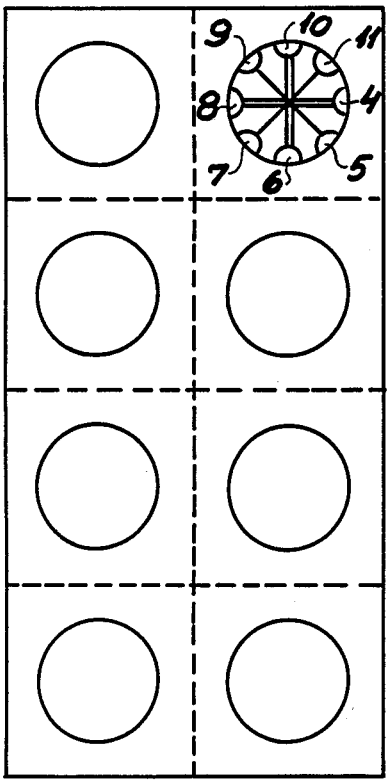
FIG. 3 is a schematic top view of a building element, provided with electric connecting means.

FIG. 3 is a schematic top view of a building element, where the top side is composed of eight module units, each of which has a coupling stud. The coupling studs are arranged, in a known manner, to cooperate with complementary coupling means in an adjacent element, so that the building elements can be coupled together. The invention concerns the type of building elements which moreover contains at least two electric current paths, the building element being formed with contact areas so shaped and placed that the separate current paths cannot short circuit by coupling of the elements in various possible positions. It will be appreciated that the desired security against short circuiting might be obtained by providing each coupling stud in FIG. 3 with eight contact areas (shown on one coupling stud only) 4–11 and by providing complementary contact areas on the underside of the element. For example, all the contact areas 4, 6, 8, 10 may be connected to one current path in the element, while all the contact areas 5, 7, 9, 11 are connected to the other current path, and it will than be readily understood that no short circuiting occurs when such elements are coupled together, the building element of FIG. 3 being of the type that can be coupled with other elements in four mutual angle positions. Since, however, the elements can be coupled in a large number of positions, where the elements may also be laterally displaced with respect to each other, it is necessary in practice that a large number of the coupling studs is provided with the said contact areas. In practice, the number of contact areas will be so large that the element can hardly be manufactured in practice because the contact areas 4, 6, 8, 10 for all the coupling studs must be interconnected (shown schematically in FIG. 3 by the double line), and the contact areas 5, 7, 9, 11 for all the coupling studs must be interconnected as well (shown schematically in FIG. 3 by a single line).

The invention is based on the finding that in the mechanical coupling of two building elements, at least two, typically four coupling studs are normally involved, and that a significantly reduced number of contact areas will suffice if the contact areas for a group of coupling studs in combination represent the necessary number of the contact areas shown in connection with one of the coupling studs in FIG. 3. The contact areas can be distributed in many ways in the building element, and some examples of preferred embodiments will therefore be given below, it having been taken into special consideration that the contact areas are so shaped and placed that the building element can be mass-produced fully automatically.

Figure 4:
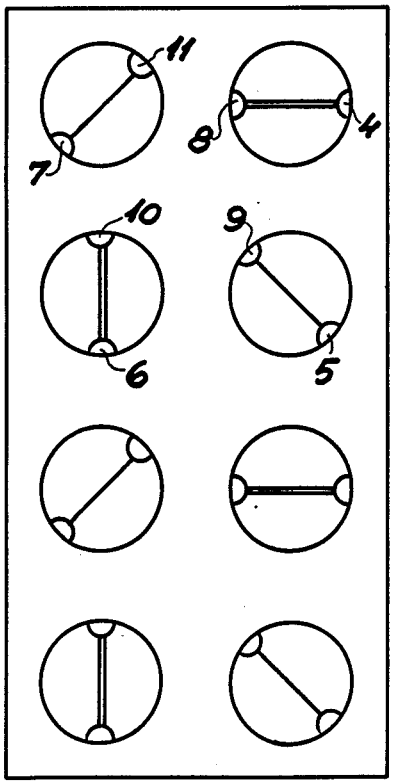
FIG. 4 is a schematic view of a building element in which the electric connecting means are distributed over a plurality of coupling studs on the building element.

FIG. 4 shows in outline an embodiment with two groups of coupling studs, each group containing four coupling studs. With reference to the above explanation it will be readily understood that the contact areas 4, 8, 6, 10 are interconnected (double line) and are connected with the corresponding contact areas in the other group (right half) of coupling studs, while the contact areas 5, 9, 7, 11 are interconnected (single line) and are connected with the corresponding contact areas in the other group of coupling studs. In the following, the contact areas on the top side of the building element will be called primary contact areas, while the corresponding contact areas on the underside of the element will be called secondary contact areas. The position shown in FIG. 4 of the primary contact areas is particularly expedient because the secondary contact areas will be very simple. It will thus be appreciated that the primary contact distribution shown in fig. 4 corresponds to a secondary contact distribution where the first current path is connected partly to the primary contact areas 4, 8, 6, 10 and partly to a secondary contact area in the form of a conductive coating on the internal side walls of the building element, and where the second current path is connected partly to the primary contact areas 5, 9, 7, 11 and partly to secondary contact areas in the form of conductive coatings on the exterior of the complementary coupling means, such as the coupling tubes 3 from fig. 2. More particularly, the conductive coatings for the first current path on the internal side walls of the building element will always make contact with one of the primary contact areas 4, 8, 6 or 10, while the internal coatings for the second current path on the coupling tubes will touch one of the primary contact areas 5, 9, 7 or 11. The constructional details of the embodiment shown schematically in FIG. 4 will be understood after the following description of some additional embodiments.

The embodiment shown in FIG. 4 has the immediate drawback that it may be difficult to interconnect the primary and the secondary contact areas of the first current path and to interconnect the primary and the secondary contact areas of the second current path in such a manner that the element can be produced fully automatically. The reason is that the connections between the primary contact areas of the first and the second current paths intersect. This can be avoided by the embodiment shown schematically in FIG. 5.

Figure 5:
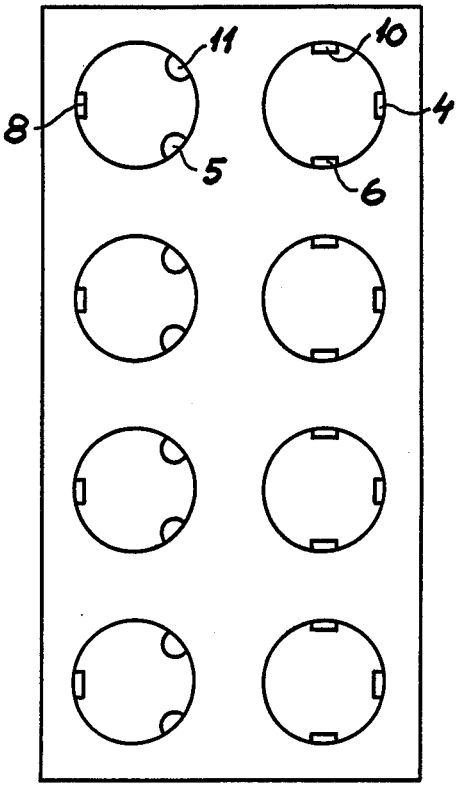
FIG. 5 shows a first embodiment of the location of primary contact areas on the building element.

In FIG. 5 the groups of coupling studs just comprise two opposite coupling studs; the location of the contact areas can best be understood by comparing the reference numerals in FIG. 5 with the reference numerals in fig. 4. It will be seen that the contact areas 7, 9 from FIG. 4 are no longer present in the embodiment shown in FIG. 5, and only some rarely used coupling possibilities are lost by this; while, on the other hand, the practical shaping of the element will be significantly simpler. The location of the secondary contact areas corresponds in principle to what was explained in connection with FIG. 4 and appears from FIG. 6, which is a bottom view of the element shown in FIG. 5. As appears from FIG. 6, each coupling tube 3 is surrounded by a conductive coating, the coatings being interconnected via intermediate members 13 and are contiguous with contact legs 14, 15, which extend through the top side of the building element and upwards along the associated coupling stud, thereby providing the conductive areas 11 and 5, respectively, shown in FIG. 5. This contact means for the second current path may be a contiguous metal piece which has been shaped before it is mounted fully automatically in the building element. As appears from FIG. 6, the first current path comprises a conductive coating 16 on the internal side walls of the building element, said coating being contiguous with some contact legs extending up through the element along respective parts of the periphery of the coupling studs to provide the primary contact areas of the first current path. More particularly, the contact leg 17 constitutes the contact area 8, while the contact legs 18, 19, 20 constitute the contact legs 10, 4 and 6, respectively. Preferably, the legs 18, 19, 20 and the corresponding legs associated with the other coupling studs are punched from a sheet metal piece 21, which is electrically connected with the conductive coating on the internal side wall of the element and which is attached in the element.

Figure 6:
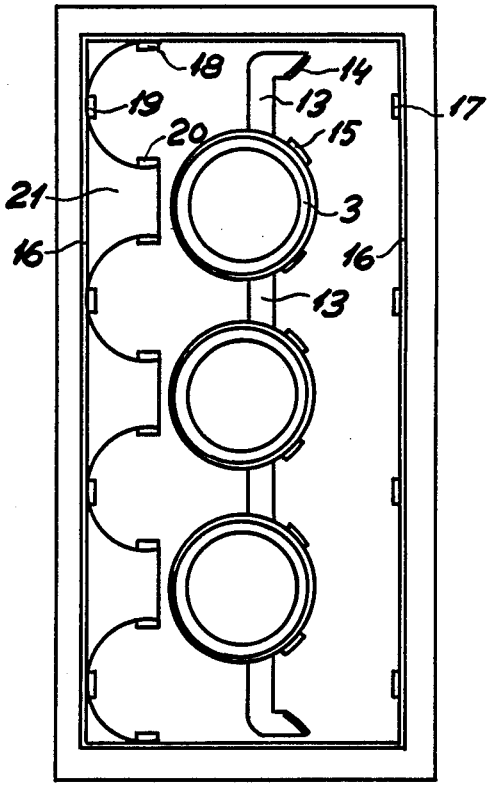
FIG. 6 shows a location of the secondary contact areas, with FIG. 6 corresponding to FIG. 5 as seen from below.
Figure 7:
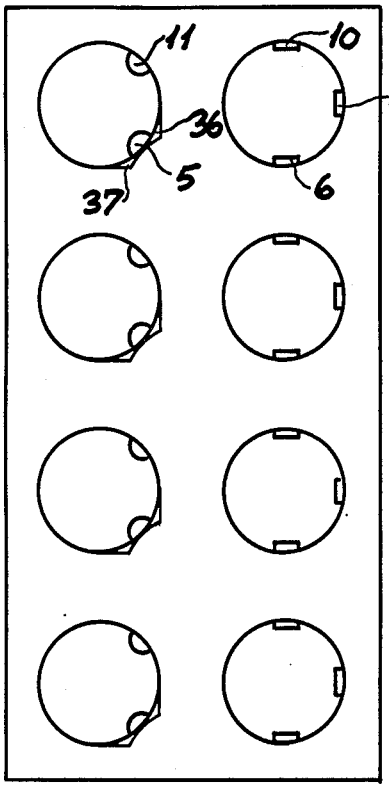
FIG. 7 shows a preferred embodiment of the location of the primary contact areas.
Figure 8:
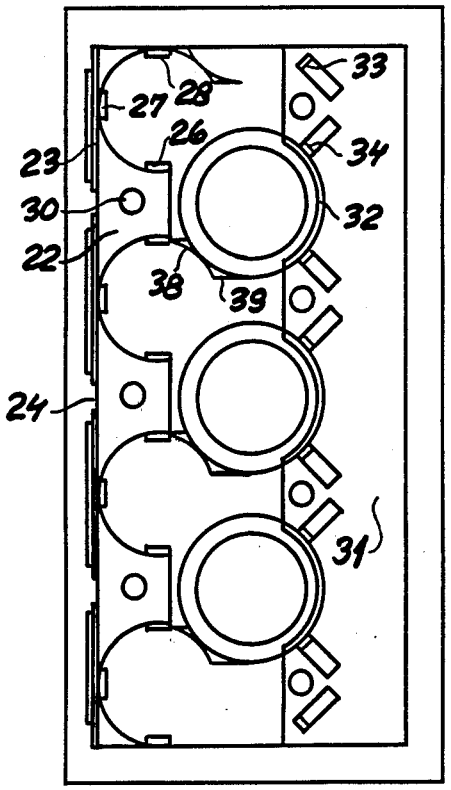
FIG. 8 shows the location of the secondary contact areas for the embodiemnt shown in FIG. 7, with FIG. 8 showing the building element of FIG. 7 from below.

In the embodiment shown in FIGS. 5 and 6 it can be seen that it is not necessary to intersect the current-carrying areas for the first and the second current paths. FIGS. 7 and 8 show an additionally simplified embodiment, and FIGS. 9, 10 show some associated current rails which are very simple to mass-produce and incorporate automatically in the building element.

The primary contact areas in the embodiment shown in FIG. 7 differ from the one shown in FIG. 5 only in the omission of the contact areas 8. This means in practice that no electrical connection is established between the first current paths if the elements are rotated mutually 180° from a position in which they run in elongation of each other and in which there is contact between the current paths. When this electrical connection possibility is waived, significant simplifications can be achieved in the arrangement of the secondary contact areas because, as far as the first current path is concerned, it is sufficient to provide a conductive rail along a single one of the internal side walls of the element, while, as far as the second current path is concerned, it is sufficient to provide half of the surface of the coupling tubes with a conductive coating. This appears more clearly from FIG. 8, which is a bottom view of the embodiment shown in fig. 7, but can best be understood by first considering the current rails shown in FIGS. 9 and 10.

Figure 9:
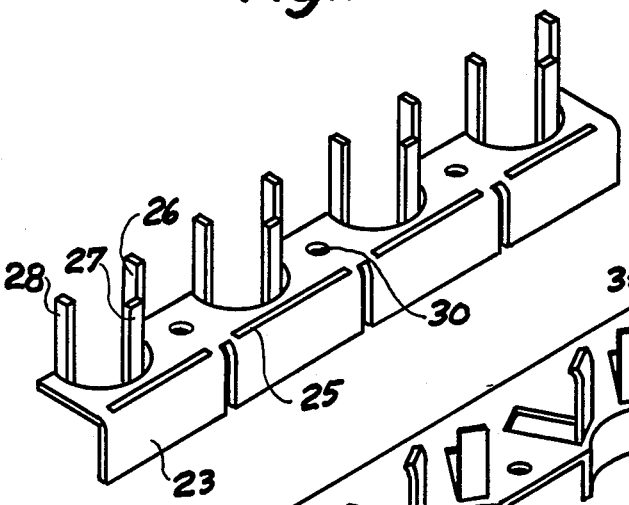
FIG. 9 shows a contact rail for the first current path in the embodiment shown in FIGS. 7 and 8.

FIG. 9 shows a current rail for the first current path, said current rail being punched from a single metal piece and bent. The contact rail comprises a plane portion 22 and four flaps 23 perpendicular to it. It can be seen from FIG. 8 how the flaps 23 are supported only at the ends of some projections 24 on the internal side of the building element, so that the flaps 23 are resilient, which is also due to the recesses 25, so that a certain resilient movement can be provided between the flaps 23, i.e. the secondary contact areas of the first current path and the primary contact areas for the first current path in an adjacent element. The last-mentioned primary contact areas are, as appears from FIG. 9, formed as three separate contact legs 26, 27 and 28 which extend up through the top side of the building element and along associated axial grooves in the associated coupling stud, so that the external surface of the contact legs is substantially flush with the external periphery of the coupling stud. The contact legs may be slightly bent at the middle, where they thus do not engage the bottom of the axial grooves so that the contact legs are resilient transversely to the curved surface of the coupling stud. To attach the contact rail, said rail may have holes 30 to receive plastics projections in the interior of the building element, said projections being deformable by heat after the contact rail has been mounted.

Figure 10:
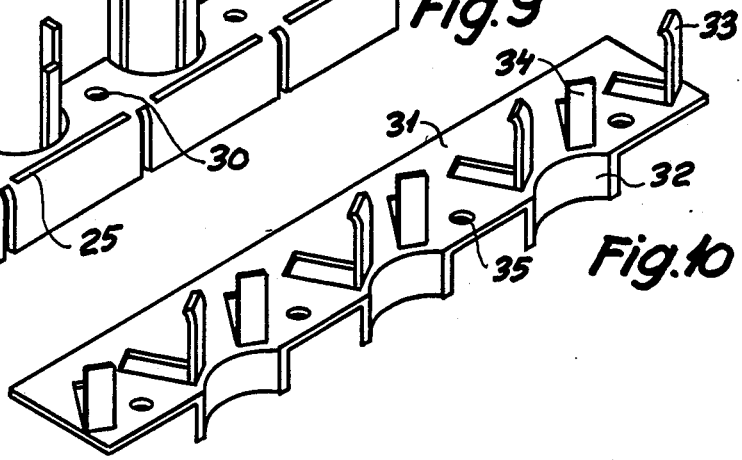
FIG. 10 shows a contact rail for the second current path in the embodiment shown in FIGS. 7 and 8.

FIG. 10 shows a contact rail for the second current path, and this contact rail, too, is punched from a single metal piece and bent. The contact rail comprises a plane portion 31, which is contiguous partly with three semicircular walls 32 and partly with a plurality of contact legs 33, 34, which also extend perpendicularly outwards from the portion 31. The contact legs 33, 34 extend through the top side of the building element and up into axial grooves in the associated coupling studs, so that the legs 33, 34 constitute the conductive areas 11 and 5, respectively, on the coupling studs. The plane portion 31 may have a plurality of holes 35 to attach the contact rail in the building element in the same manner as was explained in connection with the contact rail from FIG. 10. Instead of the holes 35, use may be made of the holes in the portion 31 which are left by the punching of the contact legs 33, 34. It will then be appreciated that the embodiment shown in FIGS. 7 and 8 is extremely simple and rational to manufacture, since the building element can be made by injection moulding of plastics in a known manner just with the modification that recesses are provided to receive partly the contact legs 26, 27, 28 and 33, 34 and partly the semi-circular walls 32, and, finally, one internal side wall may be formed with the projections 24 mentioned before. The contact legs on the contact rail shown in FIG. 10 can of course also be slightly bent at the middle, as was explained in the foregoing in connection with FIG. 9, so that these contact legs, such as the legs 33, 34, are resilient in the associated grooves in the coupling studs. It will moreover be understood that all the said contact legs are preferably bent slightly inwards at the top, so that there is no risk of the contact legs being damaged by mechanical coupling of the building elements. The contact rails from FIGS. 9 and 10 can be manufactured in long webs and be cut in desired lengths, which can be placed fully automatically in the building element, thereby providing in a simple manner an element secured against short circuiting.

As mentioned before, the embodiment shown in FIGS. 7 and 8 cannot establish electrical contact if the elements are turned 180° in elongation of each other. To point out to the user that this coupling position should be avoided (not because it results in short circuiting, but because no electrical connection is established between the current paths) the building element may contain some code projections. As shown in FIG. 7, the top side of the element may be formed with projections 36, 37 on each of the coupling studs in one row, and complementary projections 38, 39 may be provided on the underside of the element. The projections 36, 37 may have the same height as the associated coupling stud, but must be shaped so that the element can be coupled with other building elements without code projections. The projections 38, 39 need just extend a small distance into the cavity of the building element so as to ensure by cooperation with the projections 36, 37 that two building elements with electric current paths can be coupled only in the positions in which electrical connection is established, while allowing the building element to be coupled with another building element without code projections.

I claim:

1. A building element for a building set, said element comprising a plurality of contiguous module units, at least some of which have a coupling stud protruding co-axially with a central axis of the module unit so that the mutual centre-to-centre distance of the coupling studs is equal to a multiple of the module measure, said element further comprising complementary coupling tubes for cooperation with coupling studs on an adjacent element for coupling the elements together mechanically in a plurality of possible mutual angular positions, said element having a first current path connected to first contact areas designed to establish electrical connection with first contact areas in an adjacent element, said element also having a second current path electrically insulated from the first current path and connected to second contact areas designed to establish electrical connection with second contact areas in an adjacent element, characterized in that the first and the second contact areas are disposed in respective first and second angle sectors which do not ovelrap each other irrespective of mutual angular rotations corresponding to the said possible angular positions of possible mechanical coupling, and said contact areas are provided which are disposed around adjacent central axes in mutually different angle sectors.

2. A building element according to claim 1, characterized in that the contact areas comprise primary and secondary contact areas, said primary contact areas being disposed on a cylindrical surfaces of the coupling studs, said secondary contact areas being disposed on the complementary coupling means.

3. A building element in accordance with claim 2 wherein said element is adapted to be mechanically coupled to said adjacent element in four mutually perpendicular positions; characterized by said first contact areas being angularly offset from each other about said coupling stud cylindrical surface by a multiple of 90 degrees; said second contact areas being angularly offset from each other about said coupling stud cylindrical surface by a multiple of 90 degrees; and said first contact areas being offset from said second contact areas by a sum equal to a multiple of 90 degrees plus 45 degrees.

4. A building element according to claims 2 or 3, wherein at least two rows of coupling studs are provided on a top side of the element, and the underside is formed with a plurality of complementary coupling means so shaped as to allow clamping of the coupling studs on an adjacent element between the complementary coupling means and a side wall of the element, characterized in that the first secondary contact areas are disposed on the underside of the element in parallel with a longitudinal side wall, and that the second secondary contact areas are disposed on the surface of the complementary means.

5. A building element according to claim 4, characterized in that the coupling studs in a first row are exclusively provided with first primary contact areas in the form of three separate conductive areas, the tangential directions of the coupling studs adjacent the conductive areas being substantially parallel with the sides of the building element, and that the coupling studs in another row are exclusively provided with second primary contact areas in the form of conductive areas whose location corresponds to the position between the three conductive areas on the first-mentioned coupling studs.

6. A building element according to claims 2 or 8, characterized in that the first secondary contact areas consist of a contact rail placed along one internal side wall of the element, and that the second secondary contact means comprise interconnected conductive areas on the halves of coupling tubes which face away from the said side wall.

7. A building element according to claims 1, 2, 3, 5, or 6, characterized by primary and secondary code projections on the element, said projections being so positioned as to exclude certain coupling possiblities.

* * * * *